United States Patent [19]

Trotter

[11] 4,071,014

[45] Jan. 31, 1978

[54] ARROW POSITIONING DEVICE

[76] Inventor: George H. Trotter, 7107 Janey St., Shreveport, La. 71108

[21] Appl. No.: 775,418

[22] Filed: Mar. 7, 1977

[51] Int. Cl.[2] ..... F41B 5/00

[52] U.S. Cl. ..... 124/41 A; 124/88; 124/90; 124/24 R

[58] Field of Search ..... 124/80, 86, 88, 90, 124/41 A, 23 R, 24 R

[56] References Cited

U.S. PATENT DOCUMENTS

| | | | |
|---|---|---|---|
| 2,691,974 | 10/1954 | Nelson | 124/41 A |
| 3,372,686 | 3/1968 | Losh | 124/41 A X |
| 3,504,659 | 4/1970 | Babington | 124/41 A X |

*Primary Examiner*—William R. Browne
*Attorney, Agent, or Firm*—John M. Harrison

[57] ABSTRACT

An arrow positioning device for compound bows having synchronizing cables which includes an arrow positioner including a pair of retaining fingers for engagement with an arrow, and a release rod and trigger device cooperating with the retaining fingers and activated by movement of one of the synchronizing cables to permit an initial precise positioning of the fingers into arrow engaging position while the bow is in the full draw configuration and automatic retraction of the retaining fingers when the arrow is released.

10 Claims, 5 Drawing Figures

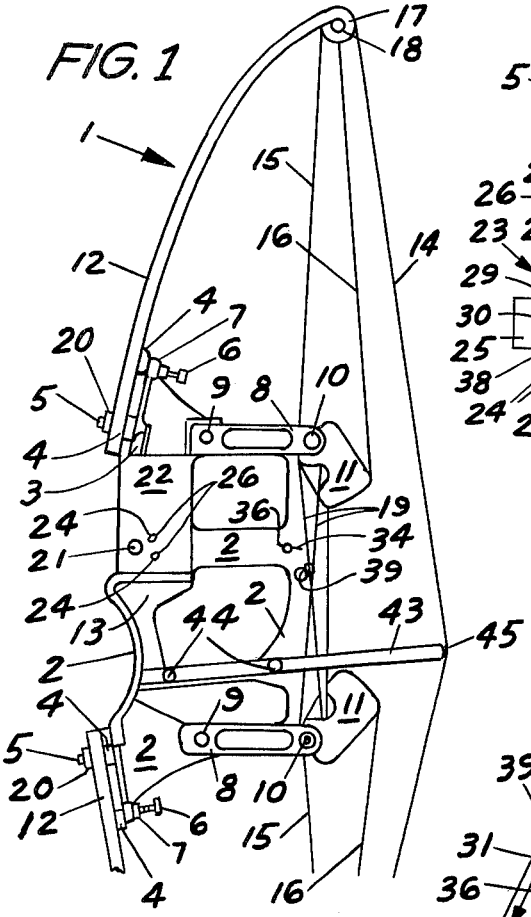
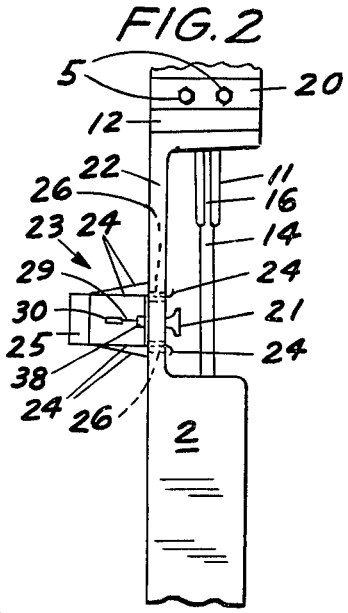
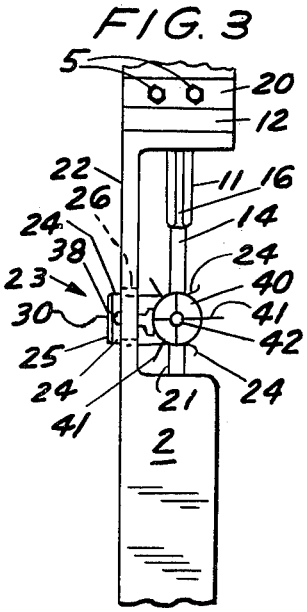
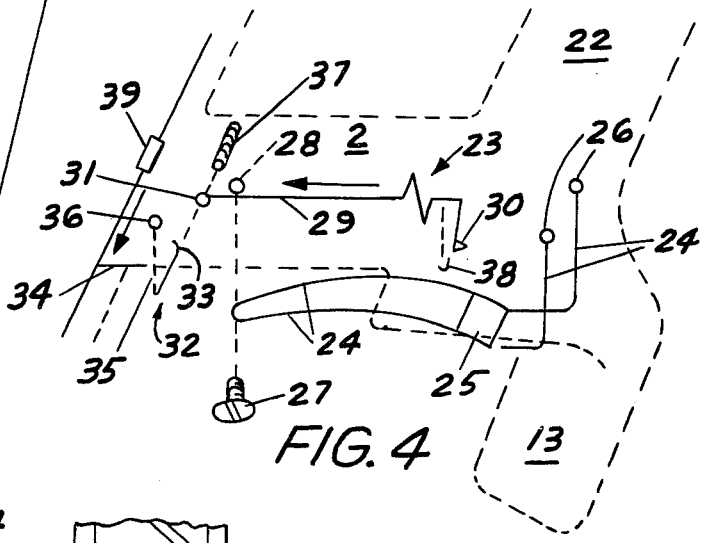
FIG. 4
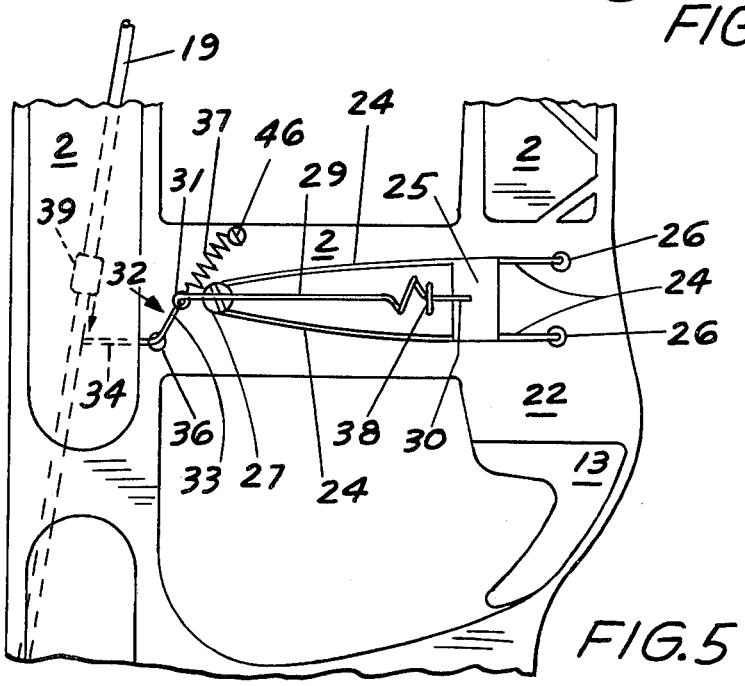
FIG. 5

ARROW POSITIONING DEVICE

BACKGROUND OF THE INVENTION

1. Field of the Invention

This invention relates to compound bows, and more particularly to an arrow retaining and positioning device for compound bows, which device is capable of initially positioning the arrow shaft in a desired location and subsequently retracting upon release of the bowstring and the arrow. The arrow positioning device is simple and reliable, and provides a positive support means for the arrow when the bow is in full draw configuration in order to aid in proper aiming of the arrow. The device is designed to immediately retract upon release of the bowstring by operation of a trigger which is responsive to movement of one of the synchronizing cables positioned in cooperation with the arrow positioning device. The arrow positioning device can be quickly and easily installed on substantially any compound bow having synchronizing cables, the general purpose of which is to synchronize the operation of cams installed on the bow in order to facilitate a desired degree of power and bowstring pressure at full draw of the bow.

2. Description of the Prior Art

Heretofore the primary means of providing a rest location for arrows in a bow, whether the bow is conventional, recurve or compound in design, is by shaping a ledge or projection in the bow handle to facilitate resting of the arrow during aiming. Various means and techniques have been utilized to provide an elevated or shaped point of rest on or near such a ledge or projection in the bow handle, but these have generally taken the form of permanently mounted devices which are capable of tearing or distorting the fletching of an arrow, and thereby promoting inaccuracy in the arrow flight. By far the most common technique utilized is simply resting the arrow shaft on the flat surface of a ledge or projection in the bow handle to provide a resting point during the aiming operation and a guide for the arrow when the bowstring is released. As the arrow moves away from the bow, the fletching must necessarily touch the ledge or projection, which contact frequently causes a deviation, however imperceptible, in the flight of the arrow. Damage to the arrow fletching also affects future arrow trajectory, with each shot of the arrow providing an aggravated condition of the fletching.

More sophisticated techniques of avoiding damage to the arrow fletching and providing a positive rest for the arrow shaft include both hinged and collapsible arrow rests which initially support the arrow shaft and either collapse or swing away from the shaft upon release of the bowstring. Such devices frequently fail to securely hold the arrow shaft in position because of the collapsing or hinged mechanism design; accordingly, while the devices are efficient in avoiding significant damage to arrow fletching, the bow cannot be conveniently tilted or abruptly turned without dislodging the arrow, and the arrow is also frequently dislodged by the wind as the bow is used.

Accordingly, it is an object of this invention to provide an improved arrow positioning device which provides a positive, secure rest for the arrow shaft and automatically retracts as the arrow is released from the bow to permit little or no contact between the arrow fletching and the bow itself.

Another object of the invention is to provide a new and improved automatically retracting arrow retaining or positioning device for compound bows having synchronizing cables which is characterized by a pair of retaining fingers which are designed to initially securely hold the shaft of an arrow in full draw position and in any bow attitude, and which retract upon release of the bowstring to facilitate clearance between the bow and the arrow fletching.

Another object of the invention is to provide a new and improved arrow retaining or positioning device for compound bows which mechanically cooperates with the synchronizing cables of the compound bows, and which is capable of initially securely supporting the arrow by means of retaining fingers during aiming, and subsequently releasing the arrow after the bowstring is released to facilitate little or no contact between the bow and the arrow fletching, and corresponding minimum deviation of the arrow from an intended flight path, and no damage to the arrow fletching.

Yet another object of the invention is to provide a new and improved arrow retaining and positioning device for compound bows having synchronizing cables, which device is characterized by a pair of projecting fingers for supporting an arrow at full draw of the bow, and in any bow attitude, which fingers are caused to retract as the bowstring is released to minimize contact between the supporting members and the bow and the arrow fletching as the arrow exits the bowstring and the bow.

A still further object of the invention is to provide an arrow positioning device for compound bows having synchronizing cables, which device is characterized by a pair of retaining fingers capable of securely supporting an arrow shaft at full draw of the bow and positioned in cooperation with a release rod and trigger, which trigger is activated by a synchronizing cable of the bow upon release of the bowstring to effect retraction of the retaining fingers and removal of arrow shaft support as the arrow is driven from the bow.

SUMMARY OF THE INVENTION

These and other objects of the invention are provided in an arrow positioning device for supporting an arrow positioned in a compound bow having synchronizing cables, which includes the following elements.

1. A pair of spaced retaining fingers which are capable of projecting into the plane of a strung arrow to engage the arrow and position it preparatory to releasing the arrow from the bow;

2. A release rod with one end in engagement with the retaining fingers; and

3. A trigger in engagement with the opposite end of the release rod and a synchronizing cable rider to effect retraction of the retaining fingers upon release of the bowstring as the arrow is driven from the bow.

BRIEF DESCRIPTION OF THE DRAWINGS

The invention will be better understood in view of the following description presented with reference to the accompanying drawings, in which:

FIG. 1 of the drawings is a side view, partially in section, of a compound bow equipped with synchronizing cables and the arrow positioning device of this invention;

FIG. 2 is a front view, also partially in section, of the bow illustrated in FIG. 1, more particularly showing the arrow positioning device in retracted position;

FIG. 3 of the drawing is another front view, partially in section, of the compound bow illustrated in FIG. 1, showing the arrow retaining device in cocked configuration with an arrow in functional position therein;

FIG. 4 of the drawing is an exploded view of the arrow positioning device, including the release rod and trigger means, more particularly showing the relationship between the parts thereof; and FIG. 5 of the drawing is a side view, partially in section, of the opposite side of the bow illustrated in FIG. 1 and more particularly illustrating a preferred mounting configuration of the arrow positioner release rod and trigger means.

DESCRIPTION OF THE PREFERRED EMBODIMENTS

Referring now to FIGS. 1-3 of the drawing, the arrow positioning device of this invention, generally illustrated by reference numeral 23, is shown mounted on the rear side of hand grip plate 22 which forms a forward structural member of frame 2 in compound bow 1. Frame 2 carries limb seats 3, upon which are mounted limb seat pads 4, which in turn carry limbs 12. Limb anchor bolts 5 and limb mount plates 20 function to securely position limbs 12 on limb seat pads 4 and limb seats 3, and limb adjusting bolts 6, in cooperation with limb adjusting nuts 7, serve to permit adjustment of limbs 12 with respect to limb seats 3 to alter the power of compound bow 1. Frame 2 also carries cam seats 8 by means of cam seat bolts 9, and cams 11 are pivotally secured to cam seats 8 on cam seat pins 10. Hand grip 13 is secured to frame 2 immediately below hand grip plate 22, and is shaped to permit a secure grip, as illustrated. Bowstring 14 spans the distance between the ends of limbs 12, and cooperates with forward tension cables 15 and limb pulleys 17, pivotally attached to the ends of limbs 12 by limb pulley pins 18, to operate cams 11 when bowstring 14 is drawn. Bowstring 14 is constrained to assume a position out of alignment with the normal, straight line position between the ends of limbs 12 by bowstring positioner pad 45, attached to the end of bowstring positioner 43. Bowstring positioner 43 is typically attached to the front side of frame 2 of compound bow 1 by bowstring positioner bolts 44. As above noted, one end of forward tension cables 15 are attached to bowstring 14 and cooperate with limb pulleys 17, while the other ends are attached to cams 11, respectively. Rear tension cables 16 are attached to cams 11 and limb pulley pins 18, respectively, to facilitate bending of limbs 12 to a power position as bowstring 14 is drawn. Synchronizing cables 19 are also fastened to cams 11 on the front side of frame 2 in crossed relationship to facilitate uniform rotation of cams 11 with respect to frame 2 as bowstring 14 is drawn. Arrow brace 21 is mounted on hand grip plate 22 in order to provide an adjustable point of rest for an arrow 40, as illustrated in FIG. 3.

Referring now particularly to FIGS. 2-5 of the drawing, the arrow positioner 23 includes retaining fingers 24 which are preferably formed of tensioned wire and are shaped as illustrated in FIG. 4. The retaining fingers 24 may be formed of a single piece of wire as illustrated, or of two pieces, the ends of which are secured to the rear side of hand grip plate 22 by means of retaining finger bolt 27. Retaining finger spacer 25 joins retaining fingers 24 to insure that retaining fingers 24 remain evenly spaced and retain a desired degree of bend to provide proper operation of arrow positioner 23, as hereinafter described.

As illustrated in FIGS. 2, 3 and 5, the free ends of retaining fingers 24 project through retaining finger apertures 26, which are preferably drilled in hand grip plate 22 at a slight angle toward each other from the reverse side of hand grip plate 22. The ends of retaining fingers 24 are also bent as illustrated, to prevent them from exiting retaining finger apertures 26 during operation of arrow positioner 23. As noted above, and as illustrated in FIGS. 4 and 5 of the drawing, retaining fingers 24 are secured to the reverse side of hand grip plate 22 by retaining finger bolt 27, which screws into retaining finger bolt aperture 28, drilled and tapped in hand grip plate 22. Release rod 29 is also slidably secured to hand grip plate 22 between retaining fingers 24, by release rod brace 38 to permit reciprocating action of release rod 29 with respect to release rod brace 38, retaining fingers 24 and retaining finger spacer 25. As illustrated in FIG. 4, release rod retainer 30 is fashioned on one end of release rod 30 to engage retaining finger spacer 25 and to bias the tensioned retaining fingers 24 against or near hand grip plate 22 and frame 2 in projecting configuration, to engage an arrow 40, as shown in FIG. 3. Release rod retainer 30 is biased in position on retaining finger spacer 25 by trigger spring 37, which engages release rod eye 31 of release rod 29. Release rod eye 31 also receives trigger hook 33 of trigger 32 in pivoting relationship. Trigger 32 is shaped to form trigger pivot 35, which projects through trigger pivot aperture 36 in frame 2, and trigger bar 34, which projects toward synchronizing cables 19 in essentially parallel relationship to the front surface of frame 2. The one of synchronizing cables 19 closest to trigger bar 34 is fitted with a cable rider 39, which is positioned above trigger bar 34 when an arrow 40 is fitted to bowstring 14 and bowstring 14 is drawn, as illustrated in FIG. 5.

Referring now to FIGS. 3 and 5 of the drawing, in operation, arrow positioner 23 functions as follows: retaining fingers 24 and retaining finger spacer 25 are initially forced downwardly against the tension in retaining fingers 24 until release rod retainer 30 engages retaining finger spacer 25 and holds the ends of retaining fingers 24 in extended position through retaining finger apertures 26, as illustrated. Retaining fingers 24 are forced toward each other because of the angle of drill of retaining finger apertures 26 to provide a secure retaining means for the arrow shaft. An arrow, 40, fitted with conventional arrow fletching 41 and having a tip 42 is then notched on bowstring 14 and positioned between the extended ends of retaining fingers 24 and against arrow brace 21. The bow is drawn, and cable rider 39 moves to a position above trigger bar 34 as synchronizing cables 19 operate to synchronize the pivoting cams 11. Arrow 40 is thus stabilized between retaining fingers 24 and against arrow brace 21 at full draw of compound bow 1, and compound bow 1 may be tilted into any configuration and rapidly moved as desired without dislodging arrow 40.

Referring now to FIG. 5 of the drawing, when bowstring 14 and arrow 40 are released, synchronizing cables 19 move rapidly as cams 11 pivot on cam seat pins 10, and cable rider 39 moves downwardly in the direction of the indicating arrow. When cable rider 39 contacts trigger bar 34 of trigger 32, trigger 32 pivots on trigger pivot 35 against the bias of trigger spring 37 to disengage release rod retainer 30 from retaining finger spacer 25. This action permits the ends of retaining fingers 24 to instantaneously retract from arrow 40 along the drilled paths of retaining finger apertures 26 to a configuration illustrated in FIG. 2 of the drawing, and as arrow 40 is driven from compound bow 1, arrow fletching 41 makes little or no contact with hand grip plate 22 or frame 2. The procedure is repeated by recocking retaining fingers 24 and stringing another arrow as described above.

It will be appreciated by those skilled in the art that while retaining fingers 24 are preferably formed of a steel wire which will retain its tension after multiple flexures, alternative materials can be utilized as desired to effect the desired retraction responsive to the trigger means. Similarly, the trigger 32 is also preferably formed of a stiff wire for ease of manufacture and reliability of operation. While a spring 37, secured by a mount screw 46, as illustrated in FIG. 5, is a preferred means of biasing release rod 29 and release rod retainer 30 against retaining finger spacer 25 of retaining fingers 24, it will also be recognized that the bias can be achieved by alternative means such as a rubber strap or the like.

Having described my invention with the particularity set forth above, what is claimed is:

1. An arrow positioning device for a compound bow comprising:

a. retaining means mounted on a bow and projecting therefrom to engage an arrow when said retaining means is extended when a bow is in a cocked condition; said retaining means including a pair of retaining fingers;

b. a release rod engaging said retaining fingers to bias said retaining fingers in a cock configuration; and c. trigger means pivotally mounted on a bow and cooperating with said release rod and a synchronizing cable for releasing said release rod, upon release of a cocked arrow, from engagement with said retaining fingers and permitting said retaining fingers to retract from contact under bias action with an arrow.

2. The arrow positioning device of claim 1 further comprising a spacer between said retaining fingers to spread said retaining fingers and to engage said release rod.

3. The arrow positioning device of claim 1 further comprising bias means for biasing said release rod in contact with said retaining fingers when said retaining fingers are in cocked configuration and in engagement with an arrow.

4. The arrow positioning device of claim 1 further comprising:

a. a spacer between said retaining fingers to spread said retaining fingers and to engage said release rod; and b. bias means for biasing said release rod in contact with said retaining fingers when said retaining fingers are in cocked configuration and in engagement with an arrow.

5. The arrow positioning device of claim 1 further comprising a cable rider on said synchronizing cable at a point above said trigger means when said retaining fingers are in cocked configuration, for striking said trigger means and retracting said retaining fingers when an arrow is released.

6. The arrow positioning device of claim 1 further comprising:

a. a spacer between said retaining fingers to spread said retaining fingers and to engage said release rod;

b. bias means for biasing said release rod in contact with said retaining fingers when said retaining fingers are in cocked configuration and in engagement with an arrow; and c. a cable rider on said synchronizing cable located at a point above said trigger means when said retaining fingers are in cocked configuration, for striking said trigger means and retracting said retaining fingers when an arrow is released.

7. The arrow positioning device of claim 1 wherein said trigger means further comprises a trigger hook in pivoting engagement with said release rod; a trigger pivot in pivoting relationship with a bow; and a trigger bar projecting in the path of a synchronizing cable when said retaining fingers are in cocked configuration.

8. The arrow positioning device of claim 1 wherein said trigger means further comprises a trigger hook in pivoting engagement with said release rod; a trigger pivot in pivoting relationship with a bow; and a trigger bar projecting in the path of a synchronizing cable when said retaining fingers are in cocked configuration; and further comprising:

a. a spacer between said retaining fingers to spread said retaining fingers and to engage said release rod;

b. bias means for biasing said release rod in contact with said retaining fingers when said retaining fingers are in cocked configuration and in engagement with an arrow; and c. a cable rider on a synchronizing cable located at a point above said trigger bar when said retaining fingers are in cocked configuration, for striking said trigger bar and retracting said retaining fingers when an arrow is released.

9. The arrow positioning device of claim 8 wherein said bias means is a spring.

10. The arrow positioning device of claim 9 wherein said bias means is a rubber band.

* * * * *